United States Patent [19]

Fukuta et al.

[11] Patent Number: 4,745,011

[45] Date of Patent: May 17, 1988

[54] TWO-COMPONENT MIXING TYPE COATING METHOD

[75] Inventors: Kenji Fukuta; Matsuo Komiyama; Kazuo Katsuyama; Minoru Tanno, all of Aichi, Japan

[73] Assignees: Toyota Jidosha Kabushiki Kaisha, Toyota; Trinity Industrial Corp., Tokyo, both of Japan

[21] Appl. No.: 864,478

[22] Filed: May 19, 1986

[30] Foreign Application Priority Data

May 17, 1985 [JP] Japan ..... 60-105703

[51] Int. Cl.[4] ..... B05D 1/08; B05D 1/10

[52] U.S. Cl. ..... 427/426; 118/300; 118/302; 239/110; 239/112; 239/413; 239/414

[58] Field of Search ..... 427/426; 118/300, 302; 239/110, 112, 413, 414, 412, 398

[56] References Cited

U.S. PATENT DOCUMENTS

| | | | |
|---|---|---|---|
| 3,073,528 | 1/1963 | Wilson et al. | 118/302 X |
| 3,450,092 | 6/1969 | Kock | 118/302 X |
| 4,265,858 | 5/1981 | Crum et al. | 239/412 |
| 4,375,865 | 3/1983 | Springer | 118/302 X |
| 4,477,494 | 10/1984 | Ali-Zaidi | 427/426 |
| 4,485,840 | 12/1984 | Erwin | 239/112 X |
| 4,529,127 | 7/1985 | Huszagh | 239/112 |

FOREIGN PATENT DOCUMENTS

| | | | |
|---|---|---|---|
| 925410 | 5/1982 | U.S.S.R. | 118/302 |

*Primary Examiner*—Shrive P. Beck

*Attorney, Agent, or Firm*—Oblon, Fisher, Spivak, McClelland & Maier

[57] ABSTRACT

A two-component mixing type coating method which is utilized for coating car components, and the like. A main component solution and a hardner solution are run together at an intermediate portion of a supply conduit and are mixed. The mixture solution is sent to a coating spray gun and injected from the gun for coating. The two-component mixing type coating method of the present invention is characterized in that check valves and stop valves are disposed at positions of the flow conduits upstream from the junction, an escape valve is connected to a flow conduit at a portion downstream from the junction, and when the coating spray operation from the coating spray gun is stopped, the escape valve is opened and then the stop valves are closed by control means.

18 Claims, 2 Drawing Sheets

TWO-COMPONENT MIXING TYPE COATING METHOD

BACKGROUND OF THE INVENTION

1. Field of the Invention

This invention relates generally to a two-component mixing type coating method which is suitable for coating car bodies, machine components, for example. The method uses a coating such as a urethane coating consisting of a mixture of two components, i.e., a main component and a hardener.

2. Discussion of the Background

The coating of car bodies, machine components, and the like, has been conducted in the past by the use of a two-component type coating. For this type of coating work, a coating supply method has generally been employed which supplies a main component and a hardener from their inividual supply sources to a coating spray gun by operating respective pumps. The main component and the hardener run together at a junction at an intermediate portion of the supply paths, mixes them together by a mixer and supplies the mixture to the spray gun. In most cases, a check valve or valves are disposed in one, or both, of the component flow paths upstream from the junction. During the supply of the main component and the hardener, particularly immediately after stopping the spraying operation of the spray gun, the main component is likely to enter the flow path of the hardener flowing from the junction or vice versa due to the difference in the supply pressures between the main component and the hardener. The check valves are disposed in the supply paths in order to prevent such a backflow.

However, when the paint spray gun is repeatedly operated and stopped and the backflowing main component (or the hardener) enters the check valve many times, the main component and hardener are mixed together and cured, and this cured product limits the opening and closing operation of the check valve. As a result, the check valve becomes fixed in a state where it is somewhat open and cannot be closed fully. Therefore the backflow cannot be prevented effectively.

Carefully noting the fact that the backflow described above occurs most often immediately after stopping the spraying operation of the coating spray gun, the inventors of the present invention have proposed placing stop valves disposed between the junction and the check valve in addition to the construction of the conventional two-component mixing type coating apparatus described above. See applicants copending U.S. Pat. No. 4,703,894 entitled "Two-Component Mixing Type Coating Apparatus" and filed on the same date as the present application and incorporated herein by reference. In this type of apparatus the backflow can be checked by the check valves during the spraying in the same way as in the prior art apparatus. Additionally, the stop valves are closed to close the supply paths when the gun stops spraying in order to reliably check the backflow. From the aspect of safety, an air pressure piping arrangement is generaly disposed between the spray gun and each stop valve as the connecting system between the coating spray gun and the stop valve. When the air pressure increases or decreases due to the stopping of the spraying operation of the gun, the pressure change is fed back so as to close the stop valve.

Although the system described above effectively prevents backflow, there is a considerably great time lag from the stopping of the spraying operation of the spray gun to the closing of the stop valve. Accordingly, when backflow occurs, the backflowing main component or hardener can enter the path near the check valve through the stop valve before the stop valve is closed. This adversely influences the opening and closing operation of the check valve.

SUMMARY OF THE INVENTION

The object of the present invention is to provide a two-component mixing type coating method which can reliably check a backflow even when the backflow occurs repeatedly and even when the velocity of the backflowing liquid is great.

This object and other objects which will become apparent from the following description of the invention are met by the two-component mixing type coating method according to the present invention which is characterized by allowing the supply paths of the two liquids to communicate with the outside in order to prevent a back-flowing of liquid, and by closing the stop valves when the spraying operation of the spray gun is stopped. In other words, when the solution of the main component and the hardener are run together at an intermediate portion of their flow paths, and are then mixed and sent to a coating spray gun, the resulting mixture is sprayed from the coating spray gun. The method of the present invention opens the check valves and the stop valves in the order named upstream from the junction, and connects an escape valve to the flow path downstream from the junction. When the coating spray gun stops spraying, the method of the invention opens the escape valve but closes the stop valves by a control means.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Other features of the invention will become apparent in the course of the following description of an exemplary embodiment which is given for illustration of the invention and is not intended to be limiting thereof.

Hereinafter, an embodiment of the present invention will be described with reference to the accompanying drawings.

Figure 1:
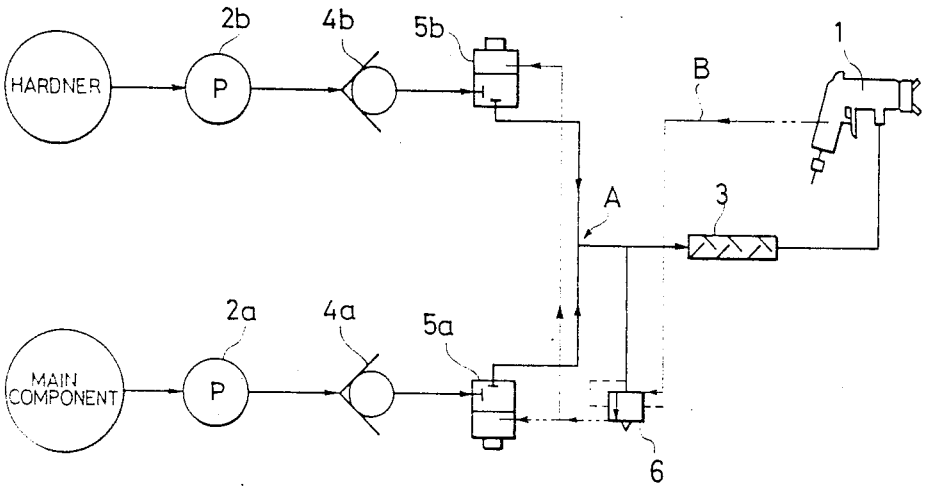
FIG. 1 shows a first example of a two-component mixing type coating apparatus utilizing the coating method of the present invention.

The present invention will be described in further detail below. As represented by a typical example shown in FIG. 1, a two-component mixing type coating apparatus used in the coating method of the present invention has the following construction. Namely, solutions of a main component and a hardener are sent from their supply sources to a coating spray gun 1 by operating their pumps *2a, 2b,* respectively, and are then allowed to run together at an intermediate portion, junction A, of their supply paths. They are then mixed together by a mixer 3 and the mixture is sent to the coating spray gun 1. In addition, check valves 4*a*, 4*b* are disposed in the flow paths between the supply sources and the junction A.

The stop valves 5*a*, 5*b* are kept open while the escape valve 6 is kept closed by control means, not shown, during the spraying operation and when the spraying is stopped a spray stop signal is sent from the spray gun 1 to the escape valve 6 and then to the stop valves 5*a*, 5*b* by use of an air pressure circuit B, or the like, and the escape valve 6 is then opened while the stop valves 5*a*, 5*b* are closed in response to this signal.

Accordingly, even when the main component (or the hardener) enters the flow path of the hardener (or the main component) from the junction A immediately after the stopping of the spraying operation, since the escape valve 6 is open in response to the stopping of the spraying operation, the inflowing main component (or hardener) can be stopped and a normal flow re-established in the normal flowing direction due to the resulting reduced pressure downstream of junction A. For this reason, even if the time lag is great from the stopping of the spraying operation till the closing of the stop valves, the backflow can be reliably checked by the subsequent closing operation of the stop valves 5*a*, 5*b*. Moreover, since the escape valve 6 is kept open for a suitable period by the control means, the entering main component (or hardener) can be vented to the outside from the escape valve 6. Although the stop valves 5*a*, 5*b* and the escape valve 6 are disposed in the supply paths, they do not eliminate the necessity of the check valves 4*a*, 4*b*. In other words, the check valves 4*a*, 4*b* are still necessary as backflow prevention members which prevent the backflow when it occurs during the spraying operation.

It is possible to use, for example, an electric circuit as the control means in the present invention, which is wired between the coating spray gun, electromagnetic stop valve and an electromagnetic escape valve. The circuit sends an ON or OFF signal as a spray stop signal representing the stopping of the spraying operation from the coating spray gun to the stop valves and to the escape valve, which opens the escape valve and then closes the stop valves.

It is also possible to use an air pressure circuit which is disposed between the coating spray gun, air type stop valves and an air type escape valve. The air pressure increases or decreases in the air pressure circuit when the gun stops the spraying operation, and this pressure change is transmitted as the spray stop signal from the coating spray gun to the stop valves and to the escape valve, and opens the escape valve in response to this signal and then closes the stop valves.

The two-component mixing type coating method of the present invention uses the stop valves as a backflow prevention means besides the check valves, and changes the flow of the backflowing solutions to the normal flowing direction by opening the escape valve. Therefore, even when the backflow occurs many times, not only during the spraying operation but also immediately after the stopping of the spraying operation, and even when the velocity of the backflow is relatively great, the present invention can reliably prevent the backflow. The method of the present invention allows for smooth spray coating for an extremely long period of time without any adverse influences caused by backflow.

Figure 2:
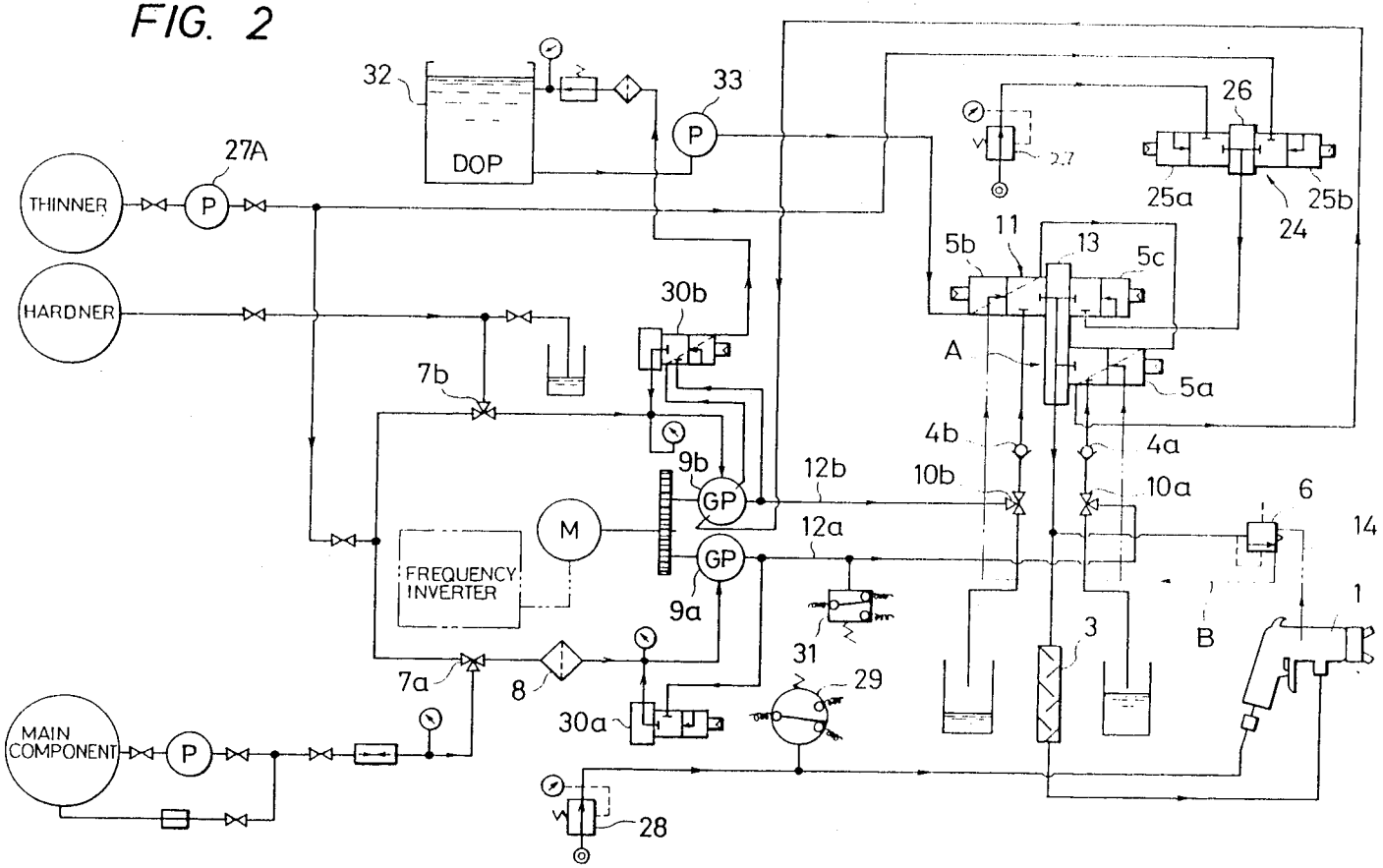
FIG. 2 shows another coating apparatus useful for practicing the method of the embodiment.

In a coating apparatus which is useful in the coating method of the present invention and which is shown in FIG. 2, the main component is supplied from its supply source to a gear pump 9*a* through a three-way cock 7*a* and a coating filter 8, while the hardener agent is supplied from its supply source to a gear pump 9*b* through a three-way cock 7*b*. The rotational speed ratio of the gear pumps 9*a* and 9*b* is controlled by a motor and a frequency inverter so that the main component and the hardener are supplied to the coating spray gun 1 from the gear pumps 9*a*, 9*b* at a predetermined ratio of flow rates such as those between 10:1.5 and 10:2.5. Thereafter, the main component and the hardener enter a valve assembly 11 through three-way cocks 10*a*, 10*b* and through the check valves 4*a*, 4*b*, join together inside the manifold of the assembly 11 (as represented by an arrow A in the drawing), are mixed by the mixer 3 and are thereafter sent to the coating spray gun 1. The mixed solution as the coating is sprayed from the gun when the trigger of the gun 1 is operated.

In this embodiment, a supply pipe 12*a* for the main component is a relatively thick pipe having an outer diameter of 8 mm and an inner diameter of 6 mm while a supply pipe 12*b* for the curing agent is a relatively thin pipe having an outer diameter of 6 mm and an inner diameter of 4 mm in order to reduce the supply pressure difference between the main component and the hardener.

The valve assembly 11 consists of stop valves 5*a*, 5*b* and 5*c* for the main component, for the hardener agent and for a thinner and air, respectively, that are arranged in the manifold 13. The stop valves 5*a* to 5*c* are disposed in the flow paths upstream from the junction A while the escape valve 6 is connected to the flow path downstream from the junction A. An air pressure circuit 14 as the control means is disposed between the spray gun 1, the escape valve 6 and the stop valves 5*a*, 5*b* and keeps the escape valve 6 closed during the coating spray operation with the stop valves 5*a*, 5*b* being kept open. On the other hand, when the coating spray operation is stopped, the spray top signal B is sent from the gun 1 to the escape valve 6 and to the stop valves 5*a*, 5*b*, so that the escape valve 6 is open and then the stop valves 5*a*, 5*b* are closed.

Figure 3:
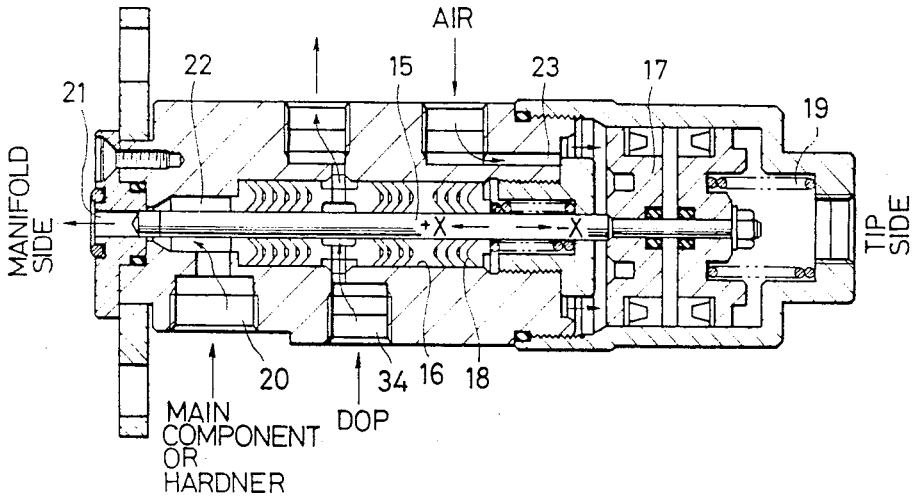
FIG. 3 is a sectional view of a stop valve used in the coating apparatus shown in FIG. 2.

The construction of each stop valve 5*a*–5*c* will be explained in further detail. As shown in FIG. 3, each of the stop valves 5*a* to 5*c* has a construction in which the needle 15 is stored in the valve chamber 16 and is fixed to, and supported by, a piston 17 capable of sliding. A V-packing 18 is fitted to the needle 15 and come into close contact with the wall of the valve chamber 16, while a spring 19 is interposed between the piston 17 and the valve main body and its spring force urges the needle 15 toward the base end (on the side of manifold). Each of the valves 5*a* to 5*c* has a coating flow path 22 that communicates an inflow port 20 on the base end side with an outflow port 21 through the needle 5, and also has an air flow path 23 that communicates the side portion of the valve with the piston 17. This air passage 23 is communicated with the air pressure circuit 14 described above. During the paint spray operation, air pressure is applied to the piston 17 through the air pressure circuit 14 and through the air path 23 so that the needle 15 move back towards the tip side (in a direction represented by −X in the drawing) against the force of the spring 19, whereby the valve is kept open. When the coating spray operation is stopped, the air pressure of the circuit 14 decreases and this pressure drop (as a spray stop signal B) is transmitted to the piston 17 through the air path 23 and the needle 15 is moved towards the base end (in the direction of +X represented by an arrow) by the force of the spring 19 and fits into the outflow port 21, whereby the coating path 22 is closed and the stop valve is also closed.

In this embodiment, the stop valve 5b for the hardener is disposed at a position upstream from the position of the stop valve 5a for the main component and moreover, in the symmetric arrangement with the stop valve 5c for the thinner in such a manner as to face the latter. If the valve 5b for the hardener curing agent is disposed at a position downstream from the position of the valve 5a for the main component, the flow of the main component having a relatively higher supply pressure enters the outflow port 21 of the valve 5b for the hardener, is mixed with the hardener and is then cured, thereby causing a problem by choking of the pipe. If the valve 5b for the hardener is disposed in such a manner as to face the valve 5c for the thinner, the flow of the thinner enters the outflow port 21 of the valve 5b for the hardener and effectively washes away the hardener agent.

The stop valve 5c is connected to a valve assembly 24, which consists of a collar valve 25a for air and a collar valve 25b for thinner that are fitted to the manifold 26. The valve 25a is communicated with an air supply source, now shown, through an air regulator 27, while the valve 25b is communicated with a thinner supply source through a pump 27A. Since the air and the thinner are supplied to the coating spray gun 1 through the valve 5c, the manifold 13 and the mixer 3, they clean the supply path from the function A to the gun 1 and can discharge the cured preduction inside the path. The valve assembly 24 is disposed in addition to, and separately from, the valve assembly 11 in order to prevent the main component and the hardener from entering the air pipe and checking the air flow.

The coating spray gun 1 is communicated with another air supply source (not shown) through the air regulator 28 and receives a supply of air for spraying the coating. An air flow switch 29 is disposed in this air path. This switch is one that indirectly detects whether or not the flow of the coating exists.

The gear pumps 9a, 9b define circulation paths in cooperation with the collar valves 30a, 30b, respectively, and the collar valves 30a, 30b are connected to a pressure switch 31 that is in turn connected to the supply pipe 12a for the main component. In a normal operation, the valves 30a, 30b are kept closed but when the supply pressure difference between the main component and the hardener becomes abnormally great, the pressure switch 31 detects the abnormal pressure difference, whereby the valve 30a or 30b is opened and an excessive quantity of the main component or hardener is returned again to the inflow port of the gear pump 9a or 9b.

In the coating apparatus of this embodiment, a DOP (solvent) flow path is defined in such a manner as to extend from a DOP tank 32, the pump 33, the stop valves 5b, 5a, the gear pump 9b, the collar valve 30b and back to the DOP tank 35. DOP is caused to flow through this path by the operation of the pump 33 in order to remove any cured product existing therein and to clean each member such as the stop valve 5b. For example, each of the stop valves 5a and 5b has the DOP path 34 extending from one of the side portions of the valve to the other side through the valve inner chamber 16, and the needle 15 can always move smoothly by causing DOP to flow through the DOP path 34 without being hindered by the main component and hardener.

When the coating work is carried out, a predetermined air pressure is applied in advance to the coating spray gun 1, and the main component and the hardener are sent from the gear pumps 9a, 9b, respectively, and are then joined together in the valve assembly 11. Thereafter, they are mixed by the mixer 3 and the coating thus prepared is sprayed by the coating spray gun 1 to coat an object. In this case, the escape valve 6 and the stop valves 5a, 5b open and close as described above in response to the coating spray operation and stopping of the spraying. Therefore, even if the backflow (mostly, the flow of the main component that enters the path of the hardener agent) occurs due to the supply pressure difference between the main component and the hardener immediately after the stopping of the coating spray operation, the escape valve 6 opens in response to the stopping of the spray operation so that the flow of the backflowing solution is stopped and then starts flowing in the normal flowing direction. Since the stop valves 5a, 5b close subsequently, the backflowing solution is prevented from flowing to the portions close to the check valves 4a, 4b. Moreover, the backflowing solution can be caused to flow outside through escape valve 6 which is open. Even if the backflow described above occurs on rare occasions during the coating spray operation, the check valves 4a, 4b can prevent the backflow. More preferably, the control means in the present invention is equipped with a sensor for sensing the occurrence of the backflow and with a timer mechanism for adjusting the open time of the escape valve in accordance with the supply pressure of the main component, for example.

After the coating work is completed, the air and the supply inner are alternately pressure-fed into the supply paths downstream from the junction from the stop valve 5c in order to discharge the main component and the hardener therefrom and to prevent choking of the supply paths.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A two-component mixing type coating apparatus, comprising:

a first source of a pressurized fluid main coating component;

a second source of a pressurized fluid coating hardener;

spray coating dispensing means;

conduit means connecting said dispensing means with said first and second sources, said conduit means including a main component flow portion connected to said first source, a hardener flow portion connected to said second source, a junction of said main component and hardener flow portions and a combined main component and hardener flow portion extending between said junction and said dispensing means;

mixing means in said combined flow portion;

a check valve positioned in each of said main component and hardener flow portions for permitting fluid flow therethrough only towards said junction;

first and second stop valves respectively positioned in said main component and hardener flow portions at points between a respective one of said check valves and said junction;

means for selectively operating said stop valves for stopping fluid flow through said main component and hardener flow portions;

means seaprate from said spray coating dispensing means for selectively venting said combined flow portion comprising:

an escape valve;

a second conduit means connecting said escape valve with said combined main component and hardener flow portion between said junction and said mixing means; and means responsive to the actuation of said dispensing means for selectively operating said escape valve.

2. The apparatus of claim 1 wherein said means for selectively operating comprise means responsive to the actuation of said dispensing means.

3. The apparatus of claim 1, wherein said stop valves each comprise:

a valve chamber having inflow and outflow ports communicating with a respective one of said flow portions;

a needle movable for blocking at least one of said inflow and outflow ports;

means for moving said needle; and means for preventing communication between said means for moving and fluid flowing in said respective one of said flow portions.

4. The apparatus of claim 2, wherein said stop valves each comprise:

a valve chamber having inflow and outflow ports communicating with a respective one of said flow portions;

a needle movable for blocking at least one of said inflow and outflow ports;

means for moving said needle; and means for preventing communication between said means for moving and fluid flowing in said respective one of said flow portions.

5. The apparatus of claim 3, wherein said means for selectively operating comprise:

an electromagnetic solenoid comprising said means for moving; and means for supplying electrical energy to said solenoid for moving said needle as a function of the actuation of said dispensing means.

6. The apparatus of claim 3 wherein said means for selectively operating comprise:

an air pressure sensitive piston comprising said means for moving; and means for supplying an air pressure change to said piston for moving said needle as a function of the actuation of said dispensing means.

7. The apparatus of claim 1 wherein a flow sectional area of said main component flow portion is greater than a flow sectional area of said hardener flow portion.

8. The apparatus of claim 4 wherein a flow sectional area of said main component flow portion is greater than a flow sectional area of said hardener flow portion.

9. The apparatus of claim 6 including:

a third source of pressurized fluid thinner;

a thinner flow portion connecting said third source with said junction; and a third stop valve positioned in said thinner flow portion.

10. The apparatus of claim 9 wherein said junction comprises a flow manifold, wherein said outflow port of each of said stop valves communicates directly with said manifold and wherein said second stop valve communicates with said manifold at a point upstream of said first stop valve in a combined fluid flow direction.

11. The apparatus of claim 10 wherein said outflow ports of said second and third stop valves face one another in said manifold.

12. The apparatus of claim 9 including means for introducing pressurized air into said thinner flow portion.

13. The apparatus of claim 9 including means for introducing a solvent into said stop valves.

14. The apparatus of claim 6 including means for introducing pressurized air directly into said dispensing means for dispensing said coating.

15. The apparatus of claim 14 wherein said means for supplying said air pressure change comprise means for detecting a supply of said pressurized air directly into said dispensing means.

16. A method for coating using a two component mixing type apparatus including a coating dispensing means, main component and hardener flow portions connected at a junction to form a combined flow portion connected to said coating dispensing means, mixing means for said combined flow portion, a selectively actuatable stop valve in each of said main component and hardener flow portions, means for pressurizing said main component and hardener for flow to said dispensing means and venting means separate from said coating dispensing means comprising a flow portion connecting an escape valve with said combined flow portion between said junction and said mixing means, and means for selectively operating said escape valve for selectively venting said combined flow portion to the atmosphere, said method comprising the steps of:

actuating said dispensing means for performing a coating operation;

providing a first signal for opening said stop valves and closing said venting means for performing a coating operation;

providing a first signal for opening said stop valves and closing said venting means in response to the initiation of said actuating step;

terminating actuation of said dispensing means; and providing a second signal for closing said stop valves and opening said venting means in response to said termination of said dispensing means.

17. The method of claim 16 wherein said first and second signals are pneumatic signals.

18. The method of claim 16 wherein said first and second signals are electrical signals.

* * * * *